United States Patent [19]

Phillips

[11] Patent Number: 4,893,543

[45] Date of Patent: Jan. 16, 1990

[54] BRAIDING MANDREL FOR CABLE GRIP AND STRAIN RELIEF ASSEMBLIES

[76] Inventor: Raymond J. Phillips, 879 Raymond Hill Rd., Oakdale, Conn. 06370

[21] Appl. No.: 376,271

[22] Filed: Jul. 5, 1989

[51] Int. Cl.[4] ..... D04C 7/00

[52] U.S. Cl. ..... 87/34; 87/9; 87/33; 87/62

[58] Field of Search ..... 87/6, 9, 29, 30, 33, 87/34, 62

[56] References Cited

U.S. PATENT DOCUMENTS

| | | | |
|---|---|---|---|
| 1,418,521 | 6/1922 | Turck et al. | 87/34 |
| 1,611,619 | 12/1926 | Turck | 87/34 X |
| 2,239,477 | 4/1941 | Yasuda | 87/34 |
| 2,557,816 | 6/1951 | Di Palma | 87/34 |
| 2,983,182 | 5/1961 | Shobert | 87/34 |

*Primary Examiner*—John Petrakes

*Attorney, Agent, or Firm*—Arthur A. McGill; Prithvi C. Lall; Michael J. McGowan

[57] ABSTRACT

A braiding mandrel for use in making cable grips and strain relief assemblies is described. The mandrel has a rod along its axis. Enclosing the rod, along its length, are hook-ring elements separated by cylindrical spacers. The hook-ring elements are flat rings with prongs extending outward. The prongs are bent upward to form hooks on which wire is wrapped to form the cable grips and strain relief assemblies.

2 Claims, 1 Drawing Sheet

BRAIDING MANDREL FOR CABLE GRIP AND STRAIN RELIEF ASSEMBLIES

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to a mandrel. More particularly the invention relates to a braiding mandrel that is used for the manufacture of braided cable grip and strain relief assemblies.

(2) Description of the Prior Art

Prior braiding mandrel design has the wire "hooks" attached to a rod or cylinder by a welding process such as gas, resistance, etc., depending on mandrel size and design. When attaching from 50 to over 300 hooks, some are less firmly attached and frequently break off as the wire is hooked over them during the braiding process. This causes down time while a repair is made. In a typical operation this happens several times a day.

SUMMARY OF THE INVENTION

The present invention is a mandrel upon which flexible wire may be braided so as to form cable grip and strain relief assemblies. The mandrel is assembled by alternately placing multi-prong hook-rings and spacers over a rod. The improved braiding mandrel saves time, results in better uniformity, and eliminates the normal repairs needed on prior art braiding mandrels.

DESCRIPTION OF THE PREFERRED EMBODIMENT

Figure 1:
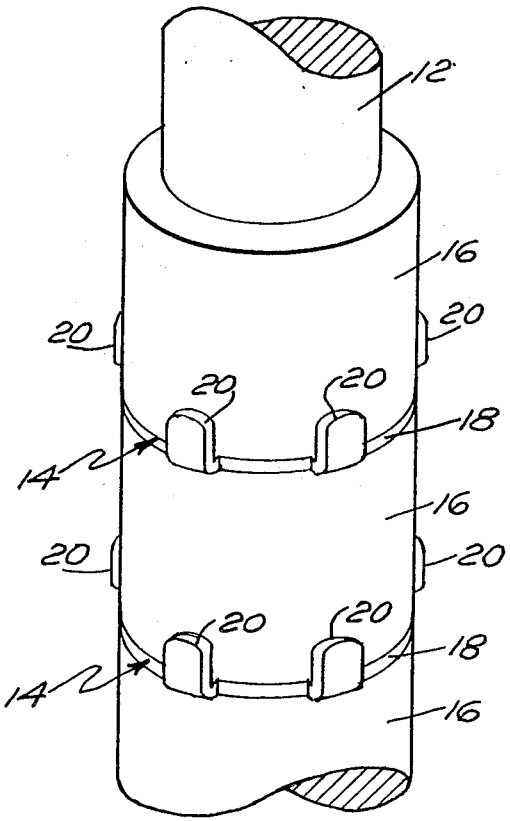
FIG. 1 is a pictorial representation of a braiding mandrel assembly in accordance with the present invention.

Referring now to FIG. 1, there is shown a braiding mandrel 10. The braiding mandrel 10 is comprised of a central rod 12 that has a plurality of five-prong hook-rings 14 and cylindrical spacers 16 placed over it. The five-prong hook-rings 14 are comprised of a flat ring 18 and hooks 20. The rod 12, hook-rings 14, and cylindrical spacers 16 all have a common axis. The braiding mandrel 10 is formed by alternately placing a hook-ring 14 and a spacer 16 over the rod 12 until the mandrel 10 is of the desired length.

Figure 2:
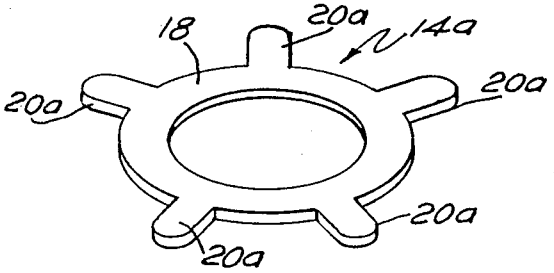
FIG. 2 shows the punched out flat blanks that are later formed into the hook rings shown in FIG. 1.

Referring now to FIG. 2 there is shown a flat blank **14*a* of annealed steel. The flat blank 14*a* comprises a flat ring 18 having prongs 20*a*. The prongs 20*a* are evenly spaced at a separation of 72 degrees around the circumference of the flat ring 18**.

Figure 3:
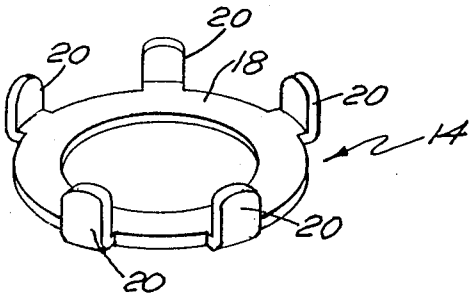
FIG. 3 shows a view of the hook-rings of FIG. 1.

This blank **14*a* is formed to the desired shape, by bending the prongs 20*a* upward 90 degrees, to form hooks 20 as shown in FIG. 3** and then heat-treated to spring temper.

Figure 4:
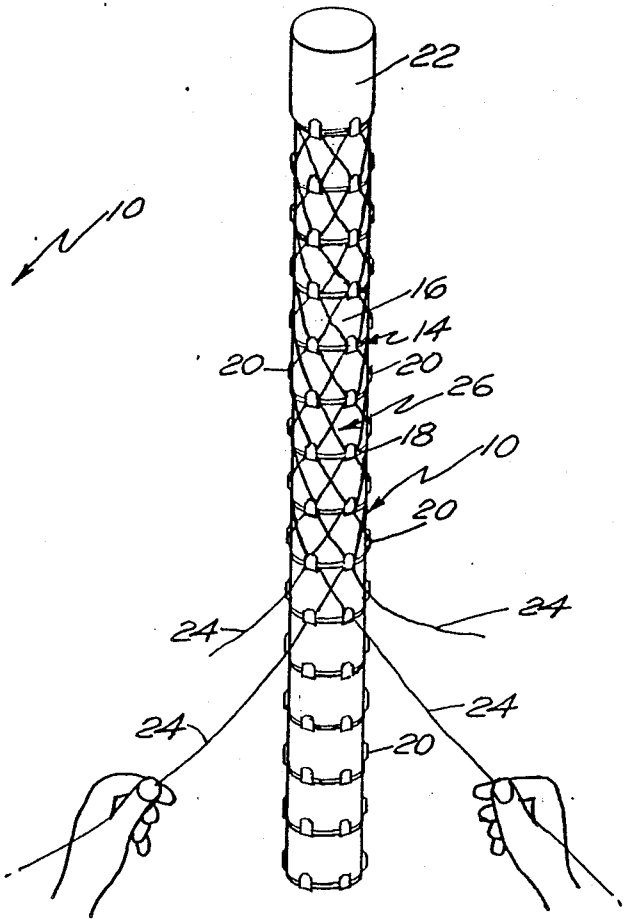
FIG. 4 shows the operation of forming a cable grip and strain relief assembly by utilizing the present invention.

Referring now to FIG. 4 there is shown the forming of a cable grip and strain relief assembly utilizing the mandrel 10. In addition to the components described earlier a wire retainer 22 is threaded onto the rod 12 (shown in FIG. 1) and braiding wire 24 forming sleeve 26 are shown. In use, the braiding wire 24 is folded over the top hooks 20, then braided downward so as to form a "chinese finger" type of sleeve 26. This technique is well known to those of skill in the art. This sleeve 26 is used for cable grip and strain relief assemblies.

There has been described a braiding mandrel 10 for cable grip and strain relief assemblies. This new design of mandrel 10 is many times stronger, more resilient, more uniform, and less prone to fatigue and failure than any of its predecessors. Many modifications are possible. The hook rings 14 can be made of alternate materials, differing sizes, and each hook ring 14 can have various numbers of hooks. Also by using spacers 16 of other lengths, differing pitches of braid angles can be made so as to accommodate the use of braided grip connectors on various materials and to render various tensile loadings.

It will be understood that various changes in the details, materials, steps and arrangement of parts, which have been herein described and illustrated in order to explain the nature of the invention, may be made by those skilled in the art within the principle and scope of the invention as expressed in the appended claims.

What is claimed is:

1. A braiding mandrel comprising:

a wire retainer;

a rod connected to said wire retainer;

a plurality of hook-ring elements placed over said rod and coaxial with said rod; and a plurality of spacer elements placed over said rod, coaxial with said rod and said plurality of hook-ring elements, and interspersed with said hook-ring elements.

2. A braiding mandrel according to claim 1 further comprising:

said spacer elements are cylindrical in shape; and each of said hook-ring elements has five hooks evenly spaced around its axis.

* * * * *